US005433399A

United States Patent [19]

Becker et al.

[11] Patent Number: 5,433,399

[45] Date of Patent: Jul. 18, 1995

[54] DEVICE FOR GUIDING A MISSILE

[75] Inventors: Wilfried Becker, Duesseldorf; Werner Grosswendt, Ratingen; Michael Schwenzer, Hermannsburg, all of Germany

[73] Assignee: Rheinmetall GmbH, Ratingen, Germany

[21] Appl. No.: 253,036

[22] Filed: Jun. 2, 1994

[30] Foreign Application Priority Data

Mar. 10, 1994 [DE] Germany ..... 44 08 085.9

[51] Int. Cl.[6] ..... F42B 15/01

[52] U.S. Cl. ..... 244/3.22; 244/3.21

[58] Field of Search ..... 244/3.22, 3.21, 3.24

[56] References Cited

U.S. PATENT DOCUMENTS

| | | | |
|---|---|---|---|
| 4,129,268 | 12/1978 | Tibbetts | 244/3.22 |
| 4,589,594 | 5/1986 | Kranz | 239/265.25 |
| 4,674,408 | 6/1987 | Stessen | 102/384 |
| 4,763,857 | 8/1988 | Booth et al. | 244/3.22 |
| 4,967,982 | 11/1990 | Bagley | 244/3.22 |
| 5,054,712 | 10/1991 | Bar et al. | 244/3.22 |

FOREIGN PATENT DOCUMENTS

| | | |
|---|---|---|
| 0128337 | 12/1984 | European Pat. Off. . |
| 3429798 | 12/1985 | Germany . |

*Primary Examiner*—Charles T. Jordan
*Assistant Examiner*—Christopher Keith Montgomery
*Attorney, Agent, or Firm*—Spencer, Frank & Schneider

[57] ABSTRACT

The invention relates to a device for guiding a missile (1; 30) with a missile tip (2) and a cylindrical section (3) adjoining the tip of the missile; the device is provided with at least one control block (4; 31, 32) with exhaust openings (13–15) of corresponding nozzle bodies (10–12) arranged perpendicularly in relation to the missile's surface.

In order to accomplish effective guidance, particularly of high-speed missiles (1; 30), in a simple and cost-effective manner it is proposed that the control block (4; 31, 32) be constructed with a plurality of small, fast-burning rocket motors (7–9; 33–36) that are arranged radially on the missile's periphery (1; 30) and that are ignitable in a predeterminable sequence and number.

4 Claims, 3 Drawing Sheets

DEVICE FOR GUIDING A MISSILE

BACKGROUND OF THE INVENTION

The invention relates to a device for guiding a missile having a missile tip and a cylindrical section adjoining the tip of the missile, with the device being provided with at least one control block with exhaust openings of corresponding nozzle bodies arranged perpendicularly in relation to the missile's surface.

From DE 3,429,798.C1 and from EP 0,128,337.B1 missiles are known where guidance of the missile is provided with the assistance of rotating thrust nozzles that are disposed in a control block in the region of the tip of the projectile. In this process, the thrust nozzles are supplied by a central propellant source and are provided with a control system for guiding a thrust jet through the corresponding exhaust opening of each respective nozzle.

Such known thrust nozzle systems have a relatively complex design and require activation of the propellant source throughout the entire flying time of the projectile so that the necessary response and reaction times, especially in high-speed missiles, can be accomplished.

It is the object of the present invention to propose a device of the type mentioned in the introduction, in which effective guidance, particularly of high-speed missiles, can be accomplished in a simple and cost-effective manner.

SUMMARY OF THE INVENTION

The above object is achieved according to the present invention by a device for guiding a missile having a missile tip and a cylindrical section adjoining the tip of the missile, with the device being provided with at least one control block with exhaust openings of corresponding nozzle bodies arranged perpendicularly in relation to the missile's surface; and wherein the control block contains a plurality of small, fast-burning rocket motors which are arranged radially on the missile's periphery and which are ignitable in a predeterminable sequence and number. Additional advantageous embodiments and features of the invention likewise are disclosed.

Substantially, the invention is based on the idea that instead of using a control block with a central propellant source and rotating nozzles, the control block is provided with a plurality of small, fast-burning rocket motors (e.g., microreaction engines) arranged radially on the periphery of the missile. The selection and number of rocket motors necessary for the required lateral thrust are ignited by an ignition device which does not have to be part of the control block. In a non-rotating missile, the rocket motors are arranged in a rotating control block.

In a particularly advantageous modification of a non-rotating missile, two control blocks rotating counter to one another are seated on the hub formed by the missile. The fact that the control blocks are rotating counter to one another leads, on the one hand, to a fast provision of all existing rocket motors for the generation of a suitable lateral thrust and thus for guiding the missile. On the other hand, a gyroscopic effect—when applying a lateral momentum and canting the tip of the missile accordingly—is avoided through the angular momentum compensation.

Additional details and advantages of the invention may be gleaned from the following exemplary embodiments explained on the basis of Figures. The Figures show:

DETAILED DESCRIPTION OF THE EMBODIMENTS

Figure 1:
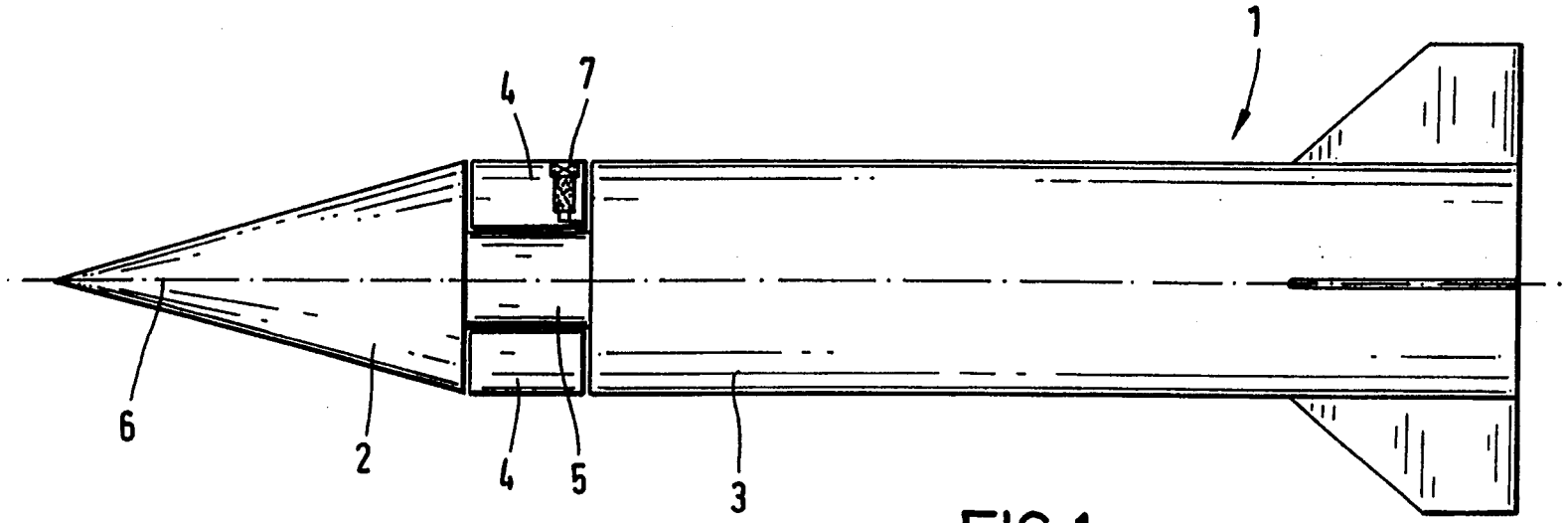
FIG. 1 shows a missile provided with a schematically indicated device according to the invention with a control block.

In FIG. 1, 1 designates a fin-stabilized projectile having a projectile tip 2 and a cylindrical section 3 adjoining the projectile tip. The cylindrical section 3 adjoining the projectile tip 2 contains a control block 4 which is rotatably seated around a hub 5 formed by the projectile 1, and thus rotatable around the longitudinal axis 6 of the projectile 1.

According to the invention, control block 4 is provided with a plurality of relatively small rocket motors, arranged radially on the periphery of the projectile 1 with of which only one rocket motor being shown in FIG. 1 and marked with reference number 7. In total, a control block 4 may be provided, for example, with more than 50 rocket motors.

Figure 2:
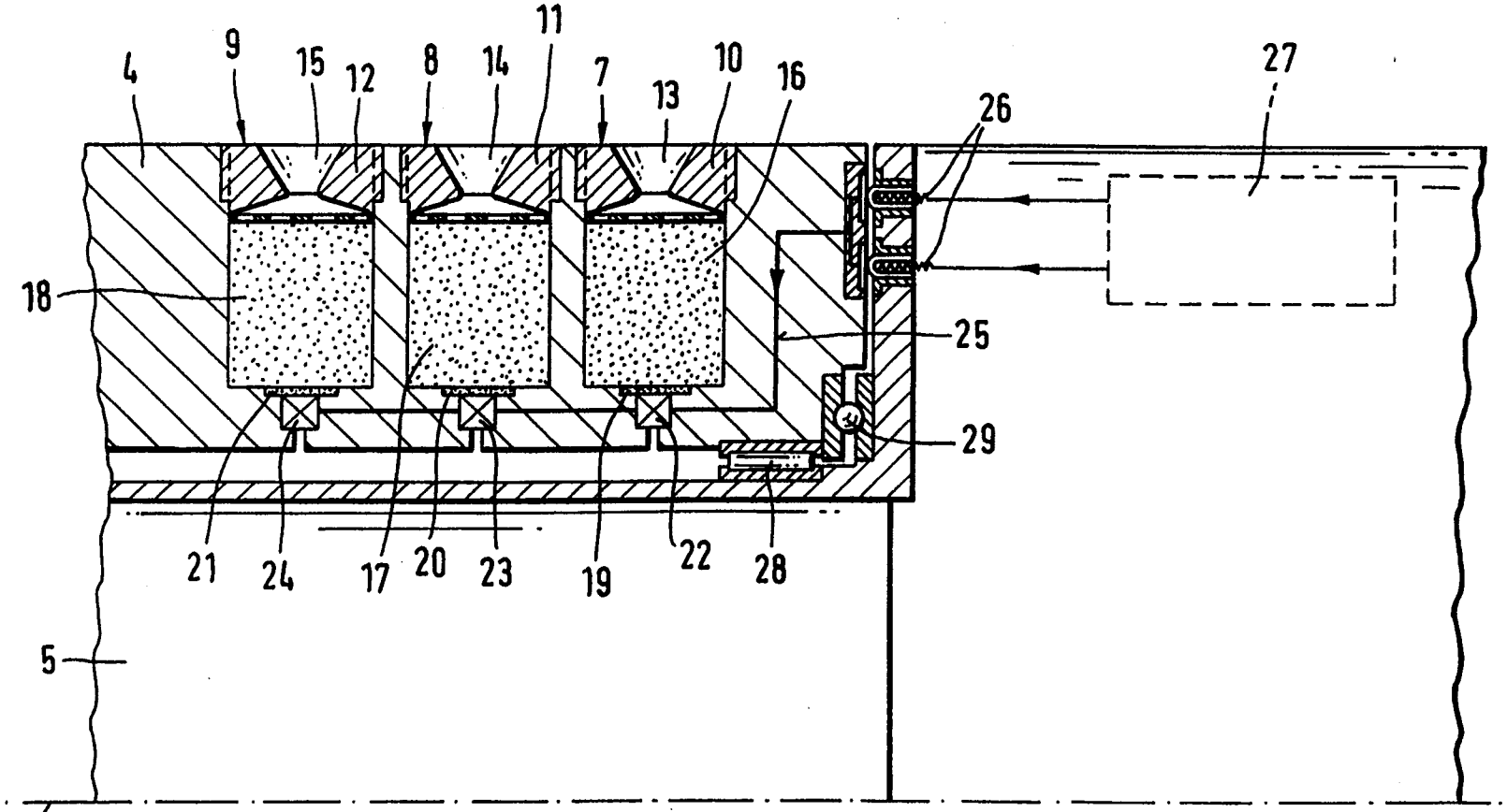
FIG. 2 is a longitudinal sectional view of the control block according to the invention shown in FIG. 1.

FIG. 2 shows a section of the control block 4 shown in FIG. 1 with three rocket motors 7–9. Each rocket motor 7–9 consists substantially of a respective nozzle body 10–12 with respective exhaust openings 13–15, a propellant charge 16–18, an igniter charge 19–21, respectively and a respective primer 22–24. The primers 22–24 are connected to an ignition device 27 not arranged in the control block 4 via electrical wiring 25 and a spring-loaded slip ring contact 26.

The corresponding ignition signals of the ignition device 27 cause the relevant primer 22–24 selected by the ignition device 27 to become activated so that the respective igniter charge 19–21 ignites the corresponding propellant charge 16–18, and the propellant charge gases thus formed escape through the respective exhaust openings 13–15 of the nozzle bodies 10–12 respectively. The lateral thrust thus created then builds up aerodynamic forces that can be used to guide the projectile 1 in a manner known per se (see, for example, EP 0,128,337.B1).

The seating of the rotating control block 4 is effected, for example, with the aid of a radial roller bearing 28 and an axial ball bearing 29 as indicated in FIG. 2.

Figure 3:
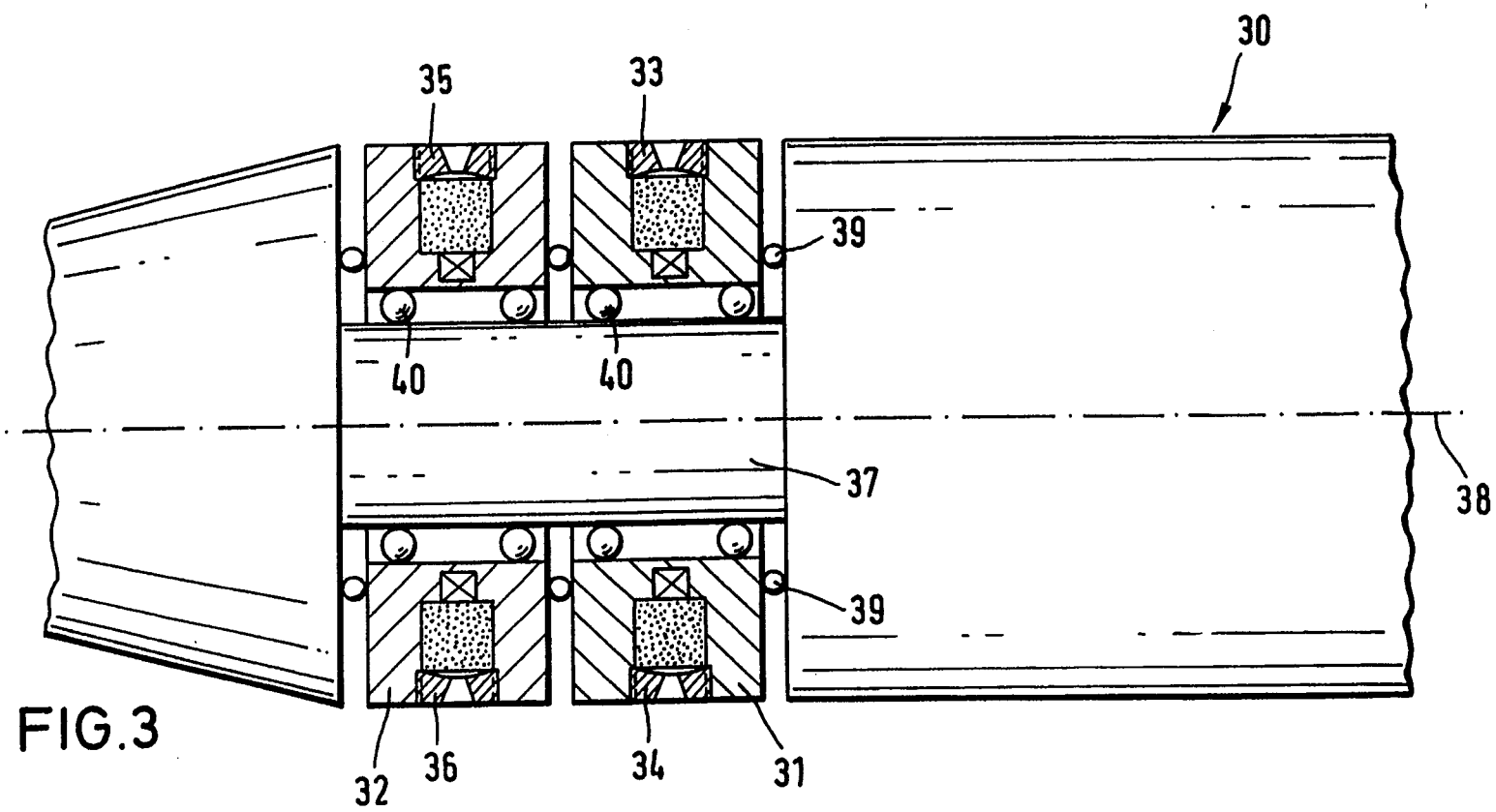
FIG. 3 is a partial longitudinal sectional view of a missile with two control blocks rotating counter to one another.

FIG. 3 shows a further exemplary embodiment of a non-rotating missile 30. For guidance purposes, this missile is provided with two separate control blocks 31, 32 with corresponding rocket motors 33, 34 or 35, 36, respectively. The control blocks 31, 32, in turn, rotate on a hub 37 formed by the missile 30 around the longitudinal axis 38 of the missile 30 and are provided for this purpose with suitable axial and radial bearings 39 and 40.

Essential in this embodiment is the fact that the two control blocks 31, 32 rotate counter to one another. This leads, on the one hand, to a fast provision of all existing rocket motors 33–36 for the generation of a suitable lateral thrust and thus for guiding the missile 30. On the other hand, a gyroscopic effect—when applying a lateral momentum and canting the tip of the missile accordingly—is avoided through the angular momentum compensation.

Rotation of the two control blocks 31, 32 can be initiated with either small suitably shaped aerodynamic fins or small rocket motors with two tangential nozzles each (not shown). Based on experience, the rotational frequency should be approximately. 10 Hz.

We claim:

1. In a device for guiding a missile having a missile tip and a cylindrical section adjoining the tip of the missile, said device having at least one control block with exhaust openings for corresponding nozzle bodies arranged perpendicularly in relation to the missile's surface; the improvement wherein: the at least one control block contains a plurality of small, fast-burning rocket motors which are arranged radially on the periphery of the missile and which are ignitable in a predeterminable sequence and number; and two said control blocks that can rotate counter to one another around the longitudinal axis of the missile are provided.

2. Device in accordance with claim 1, wherein said control blocks are disposed in the cylindrical section of the missile directly adjoining the tip of the missile.

3. Device in accordance with claim 1, wherein a rotational frequency of the control blocks is approximately 10 Hz.

4. Device in accordance with claim 2, wherein a rotational frequency of the control blocks is approximately 10 Hz.

* * * * *